US008747076B2

(12) United States Patent
Wang

(10) Patent No.: US 8,747,076 B2
(45) Date of Patent: Jun. 10, 2014

(54) PORTABLE AIR PUMP WITH A HIDDEN PRESSURE GAUGE

(75) Inventor: Lopin Wang, Taichung (TW)

(73) Assignee: Beto Engineering and Marketing Co., Ltd., Taichung (TW)

( * ) Notice: Subject to any disclaimer, the term of this patent is extended or adjusted under 35 U.S.C. 154(b) by 182 days.

(21) Appl. No.: 13/250,370

(22) Filed: Sep. 30, 2011

(65) Prior Publication Data

US 2013/0028756 A1 Jan. 31, 2013

(30) Foreign Application Priority Data

Jul. 27, 2011 (TW) ..... 100126622 A

(51) Int. Cl.
*F04B 53/22* (2006.01)

(52) U.S. Cl.
USPC ..... 417/234; 417/63; 73/756

(58) Field of Classification Search
USPC ..... 417/63, 234; 73/756
See application file for complete search history.

(56) References Cited

U.S. PATENT DOCUMENTS 1,310,876 A * 7/1919 Savage ..... 417/63
5,964,577 A * 10/1999 Chuang ..... 417/63
6,558,129 B2 * 5/2003 Wang ..... 417/63
6,893,232 B2 * 5/2005 Wu ..... 417/547
2002/0162717 A1 * 11/2002 Lin et al. ..... 190/18 R
2002/0174723 A1 * 11/2002 Chuang ..... 73/700
2007/0228797 A1 * 10/2007 Wang ..... 297/410

* cited by examiner

*Primary Examiner* — Devon Kramer
*Assistant Examiner* — Charles W Nichols
(74) *Attorney, Agent, or Firm* — Muncy, Geissler, Olds & Lowe, P.C.

(57) ABSTRACT

A portable air pump includes a pump body, a base member affixed to the pump body and defining therein an accommodation chamber, a casing movable in and out of the accommodation chamber between an exposed position and a hidden position, a pressure gauge mounted in the casing and kept in air communication with the pump body, a footplate pivotally pivoted to the pump body and biasable between a received non-operative position and an extended operative position, a spring member set between the casing and the base member and adapted for forcing the casing from the hidden position to the exposed position, locking device adapted for locking the casing in the hidden position or unlocking the casing to allow the spring member to force the casing to move from the hidden position to the exposed position when the footplate is biased from the received non-operative position to the extended operative position.

3 Claims, 9 Drawing Sheets

PORTABLE AIR PUMP WITH A HIDDEN PRESSURE GAUGE

BACKGROUND OF THE INVENTION

1. Field of the Invention

The present invention relates to air pumps and more particularly, to a portable air pump equipped with a hidden pressure gauge.

2. Description of the Related Art

Conventional portable air pumps are commonly designed to be operated by both hands. During operation, the user shall have to hold the pump body with one hand and operate the pumping handle with the other hand. The user will get tired easily when operating a portable air pump in this manner. To overcome this problem, portable floor type air pumps are developed. When using a portable floor type air pump, the user can stop one end of the pump body against the floor and then reciprocate the pumping handle with one single hand. This operation method requires less effort. However, in conventional designs, the pressure gauge is normally installed in the pump body. When the pump body is kept in vertical and stopped against the floor, the user cannot view the readings of the pressure gauge. To facilitate viewing the readings of the pressure gauge, U.S. Pat. No. 6,558,129 discloses an air pump entitled "Air pump having pressure gauge thereon", in which the pressure gauge has a face marked with indication signs in the negative form; a cover is hinged to the base of the air pump for closing the pressure gauge and has a mirror disposed at the inner side thereof and adapted to reflect the image of the reading of the indication signs of the pressure gauge. However, when the cover is opened from the pressure gauge, it is not kept perpendicular to the pump body to facilitate viewing of the reflected image of the reading of the indication signs of the pressure gauge. If the cover is kept perpendicular to the pump body when opened, the mirror cannot reflect the image of the reading of the indication signs of the pressure gauge.

SUMMARY OF THE INVENTION

The present invention has been accomplished under the circumstances in view. It is the main object of the present invention to provide a portable air pump with a hidden pressure gauge, which facilitates viewing of the readings of the pressure gauge during operation.

To achieve this and other objects of the present invention, a portable air pump comprises a pump body, an accommodation chamber defined in the pump body, a pressure gauge accommodated in the accommodation chamber and movable in and out of the accommodation chamber between an exposed position where a person can view the pressure readings of the pressure gauge directly and a hidden position where the pressure gauge is received in the pump body and kept from sight.

Other advantages and features of the present invention will be fully understood by reference to the following specification in conjunction with the accompanying drawings, in which like reference signs denote like components of structure.

DETAILED DESCRIPTION OF THE INVENTION

Figure 1:
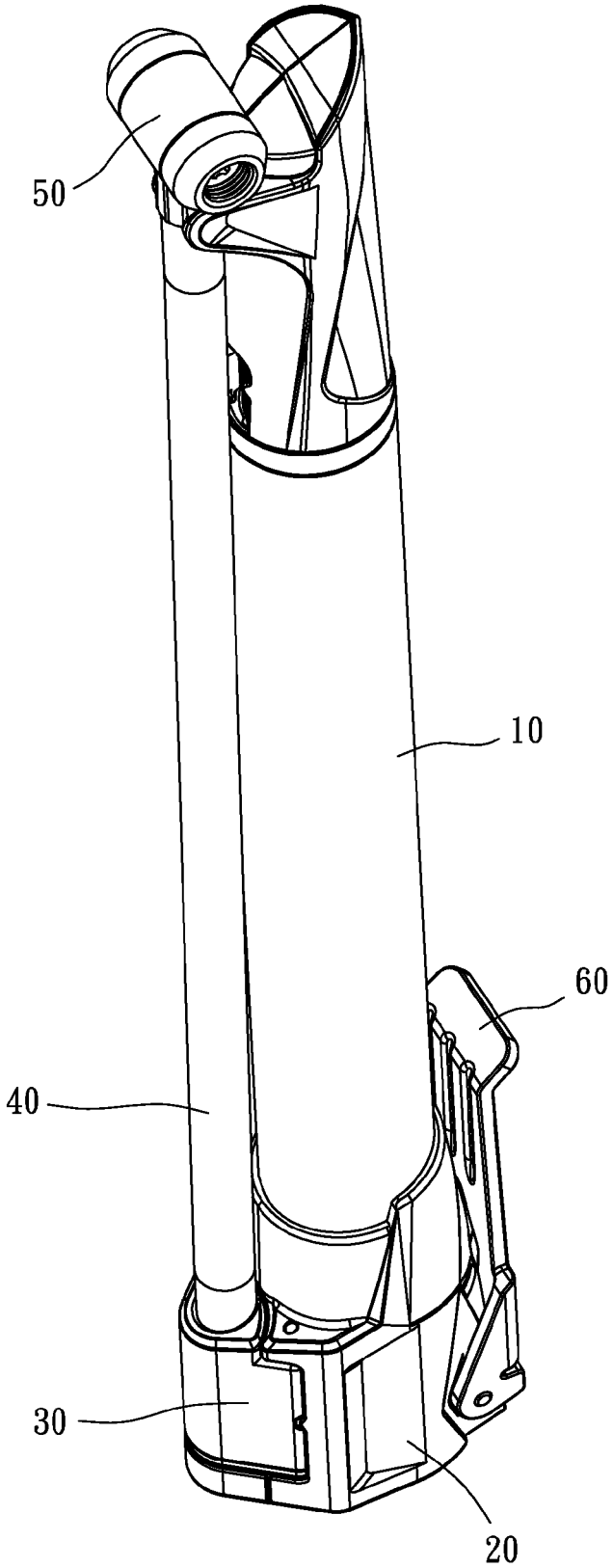
FIG. 1 is an elevational view of a portable air pump in accordance with the present invention, illustrating the pressure gauge in the hidden position.
Figure 2:
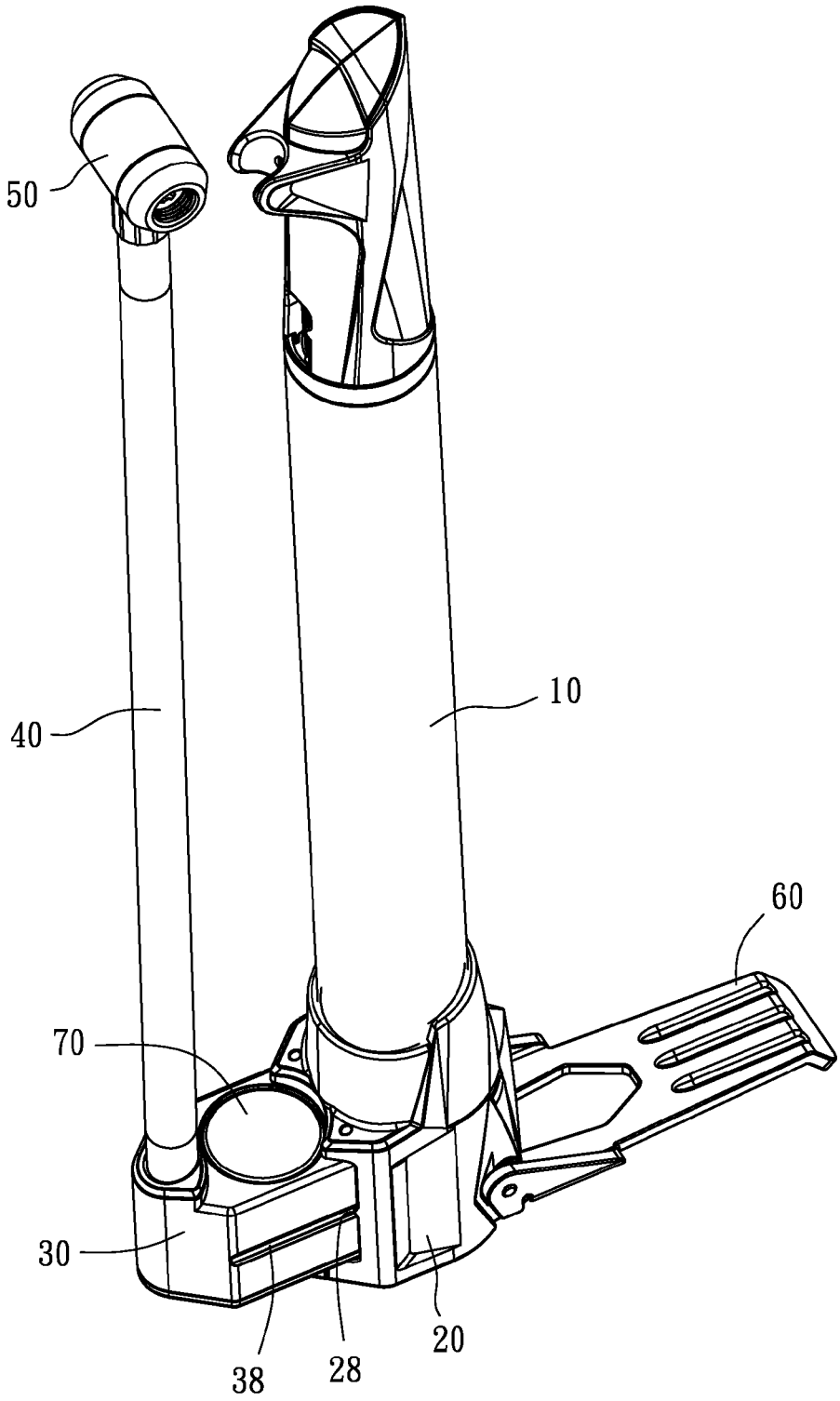
FIG. 2 corresponds to FIG. 1, illustrating the pressure gauge in the exposed position.
Figure 3:
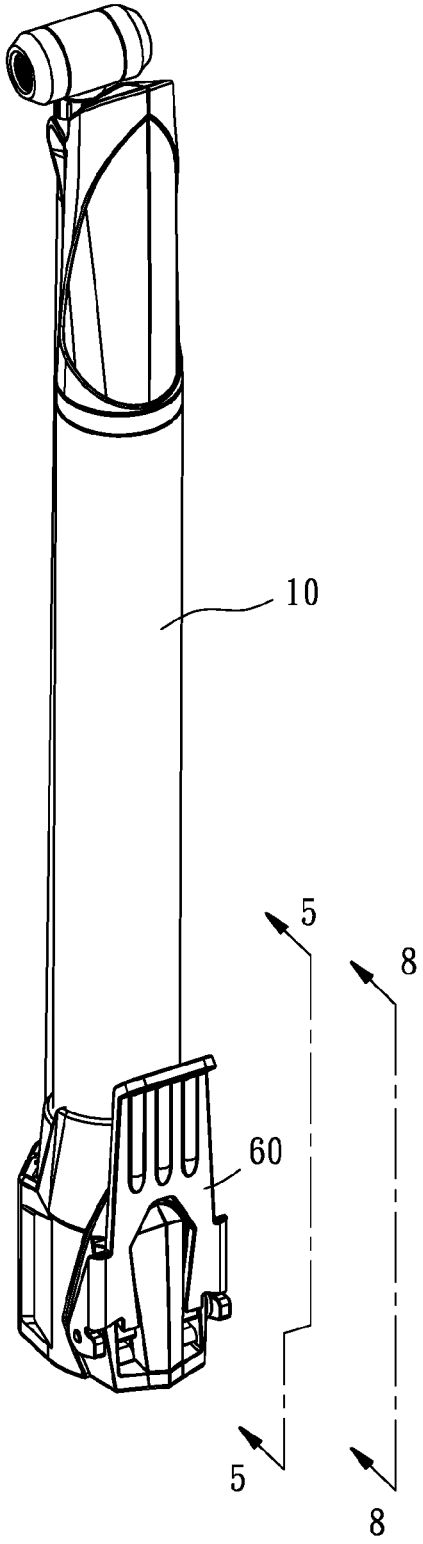
FIG. 3 is similar to FIG. 1 when viewed from another angle.
Figure 4:
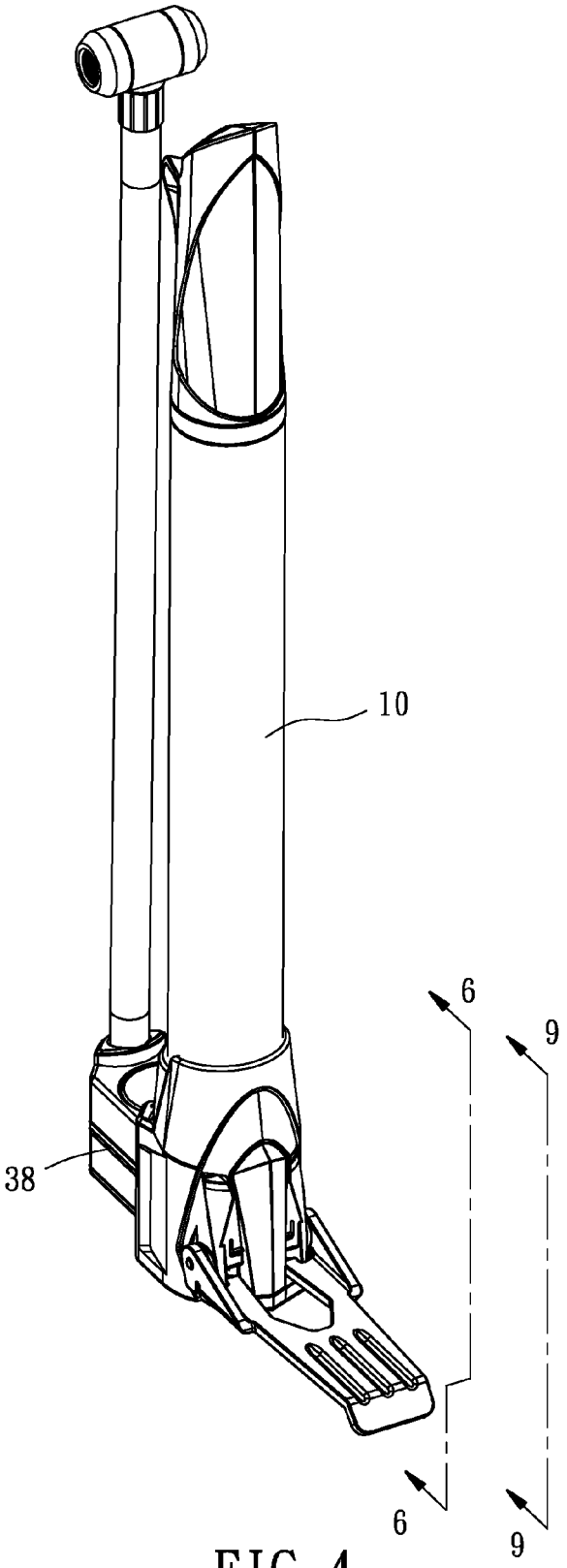
FIG. 4 is similar to FIG. 2 when viewed from another angle.

Referring to FIGS. 1~4, a portable air pump in accordance with the present invention is shown comprising a pump body 10, a base member 20 located on the bottom side of the pump body 10, a casing 30 accommodated in the base member 20, a flexible air tube 40 extended out of the casing 30, an air valve connector 50 located on the free end of the flexible air tube 40 remote from the casing 30, a footplate 60 pivotally connected to one side of the base member 20 and biasable within about 90-degrees between an extended operative position and a received non-operative position, and a pressure gauge 70 arranged in the top side of the casing 30. When the portable air pump is not used, the casing 30 is kept in the base member 20. When using the portable air pump, the casing 30 can be moved by an external force out of the base member 20 to expose the pressure gauge 70.

The simplest displacement design of the casing 30 is to let the user move the casing 30 in and out of the base member 20 between the hidden position and the exposed position directly with the fingers.

Figure 5:
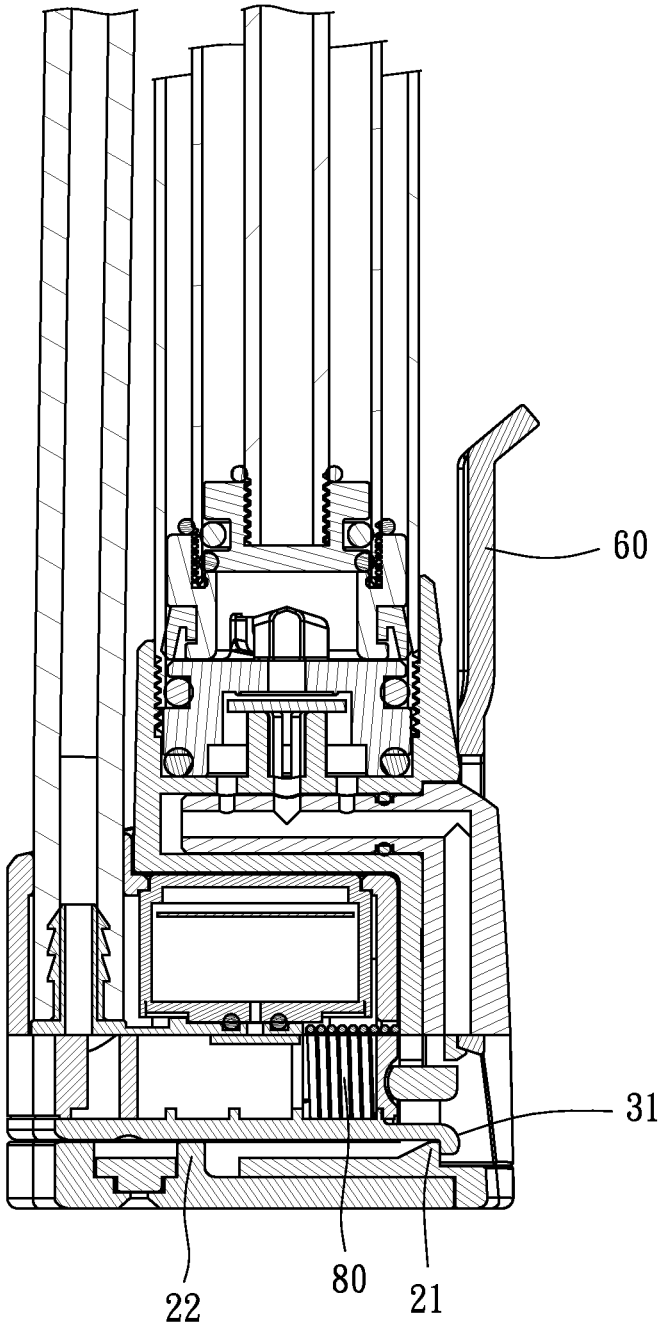
FIG. 5 is a sectional view taken along line 5-5 of FIG. 3.
Figure 6:
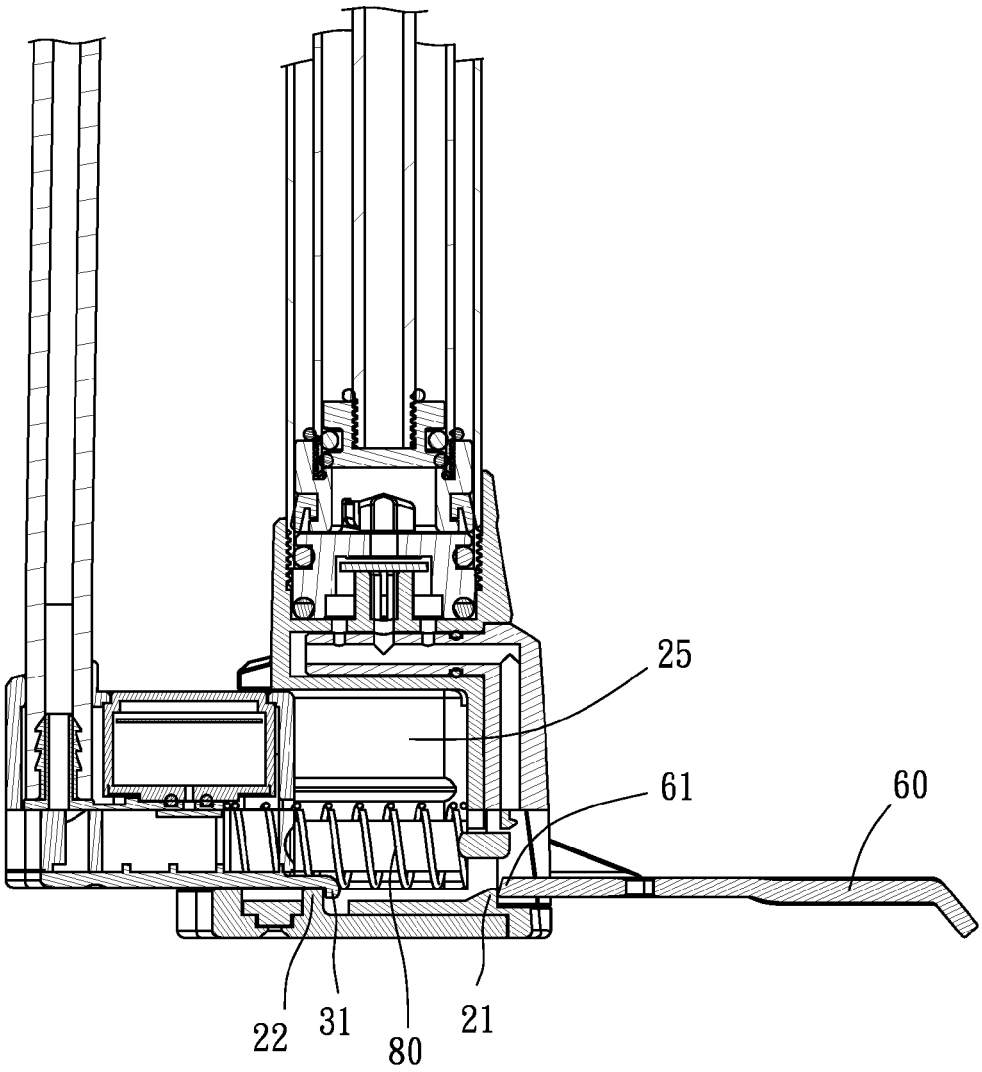
FIG. 6 is a sectional view taken along line 6-6 of FIG. 4.
Figure 7:
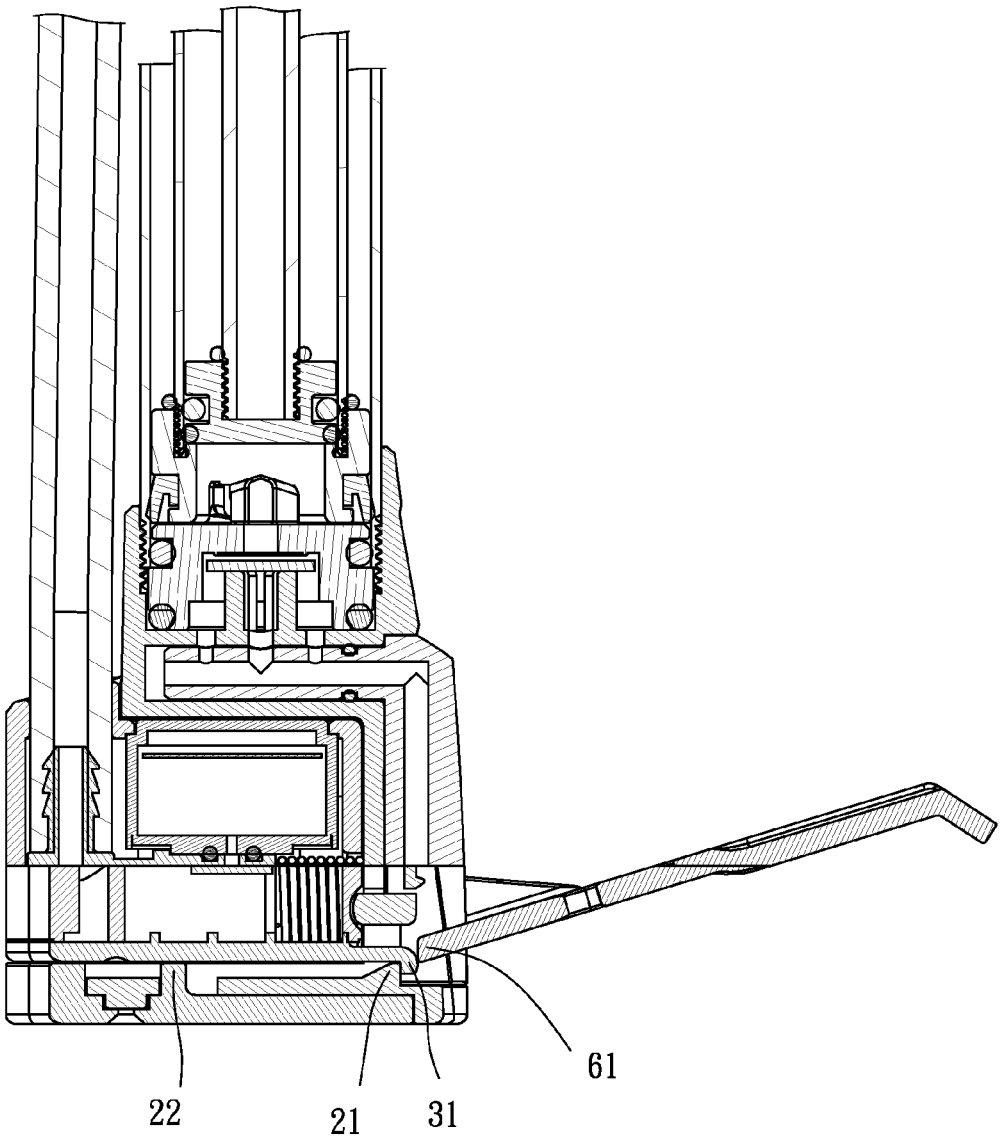
FIG. 7 corresponds to FIG. 6, illustrating the casing-ejection operation of the footplate (control member)

In this embodiment, an auto ejection structure is provided for ejecting the casing 30 out of the base member 20 to expose the pressure gauge 70, and a control member, i.e., the footplate 60 is configured for controlling the ejection. As the portable air pump is a floor type design, the user must extend out the footplate 60 to the position perpendicular to the pump body 10 when using the portable air pump, it is therefore the best choice to design the footplate 60 in such a manner that the casing 30 is automatically ejected out of the base member 30 when the footplate 60 is turned outwardly to about the 90 degrees angle. As illustrated in FIGS. 5~7, the base member 20 comprises an accommodation chamber 25 adapted for accommodating the casing 30, and two retaining members 21 (raised hooks) bilaterally located on the bottom wall thereof in the accommodation chamber 25 and disposed near the footplate 60. Further, the casing 30 comprises two retaining members 31 (downwardly curved hooks) configured for engagement with the retaining members 21 of the base member 20. The retaining members 21 and the retaining members 31 work as locking means for locking the casing 30 to the base member 20 in the accommodation chamber 25. Further, a spring member 80 is set between the casing 30 and the base member 20. When the casing 30 is received inside the base member 20, the retaining members 31 of the casing 30 are respectively kept in engagement with the retaining members 21 of the base member 20, and at this time, the spring member 80 is compressed. Further, the footplate 60 comprises an actuating portion 61 located on one end thereof corresponding to the retaining members 31 of the casing 30. When wishing to use the portable air pump, turn the footplate 60 from the received non-operative position to the extended operative position. When the footplate 60 is approaching the extended operative position, the actuating portion 61 will be forced to push the retaining members 31 of the casing 30 away from the retaining members 21 of the base member 20, enabling the casing 30 to be forced out of the base member 20 by the elastic restoring force of the spring member 80 to expose the pressure gauge 70. In order to limit the range of outward displacement of the casing 30, a stop block 22 is arranged on the bottom wall of the base member 20 near the flexible air tube 40. When the casing 30 is moved outwardly to the exposed position, the retaining members 31 of the casing 30 will hook on the stop block 22 to stop the casing 30 in the exposed position.

Figure 8:
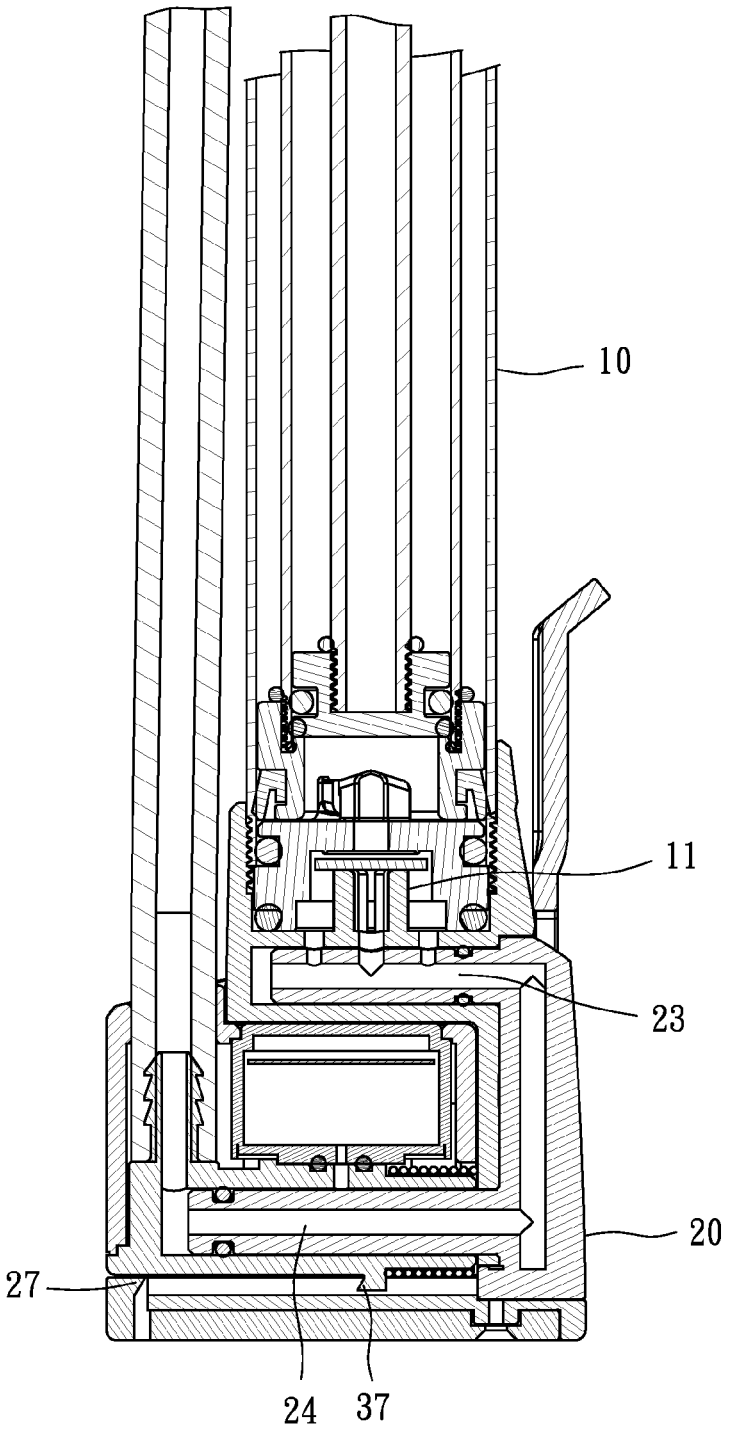
FIG. 8 is a sectional view taken along line 8-8 of FIG. 3.
Figure 9:
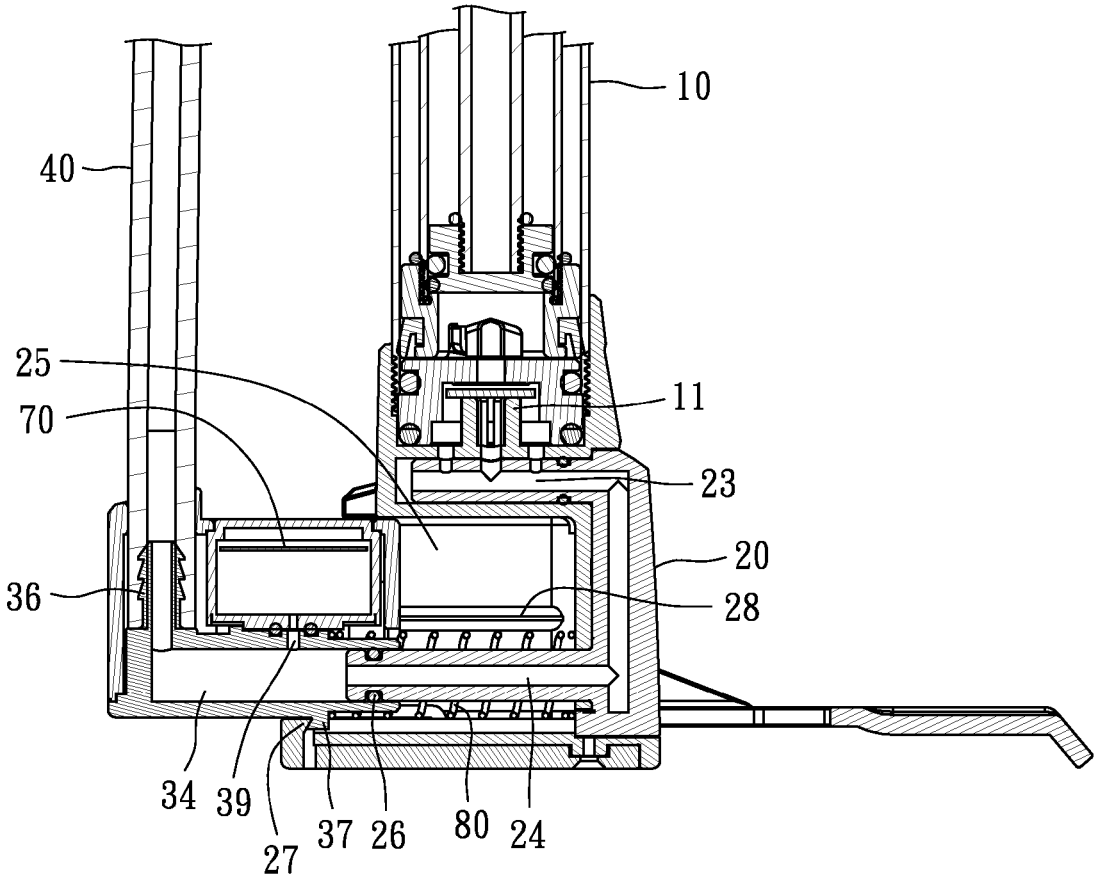
FIG. 9 is a sectional view taken along line 9-9 of FIG. 4

Referring to FIGS. 8 and 9, the portable air pump can be a single-cylinder, dual-cylinder or multi-cylinder foot air pump of single-acting or double-acting design. According to the present preferred embodiment, the portable air pump is a dual-cylinder, telescopic type, single-acting design having a check valve 11 mounted in the connection area between the bottom side of the pump body 10 and the base member 20, a flow passage 23 defined in the base member 20 in communication with the check valve 11, a flow guide tube 24 arranged in the accommodation chamber 25 inside the base member, a tube hole 34 defined in the casing 30 and holding the flow guide tube 24 in place, a seal ring 26 fastened to the connection area between the flow guide tube 24 and the tube hole 34 to prevent leakage. Further, the spring member 80 is mounted around the flow guide tube 24. The tube hole 34 is equipped with a connector 36 for the connection of the flexible air tube 40. Further, a through hole 39 is formed in the casing 30 in communication between the tube hole 34 and the pressure gauge 70. During operation of the portable air pump, pumped air goes through the check valve 11 into the flow passage 23 and then into the tube hole 34 via the flow guide tube 24, and then into the air valve connector 50 through the flexible air tube 40 to inflate the attached inflatable object (not shown). As this time, the pressure of the pumped air does through the through hole 37 into the pressure gauge 70, causing the pressure gauge 70 to provide a pressure reading indicative of the pressure of the pumped air. As the pressure gauge 70 is kept facing up, the user can view the pressure reading conveniently. Further, the base member 20 further has a stop portion 27 defined therein. Further, the casing 30 defines a stop portion 37, which will be stopped at the stop portion 27 of the base member 20 when the casing 30 is moved out of the base member 20, avoiding falling of the casing 30 out of the base member 20. To facilitate reciprocating motion of the casing 30 in the accommodation chamber 25 of the base member 20, the case member 20 is designed to provide two sliding rails 28, and the casing 30 is made having two sliding grooves 38 symmetrically disposed at two opposite lateral sides and respectively coupled to the sliding rails 28 of the base member 20. Thus, the casing 30 can be moved in an out of the base member 20 smoothly and stably.

The embodiment described above is simply an example of the present invention. Other modifications and changes may be made without departing from the spirit and scope of the invention. For example, the flexible air tube 40 can be directly affixed to the base member 20 and kept in communication with the check valve 11, and the pressure gauge 70 can be connected to the flexible air tube 40 and the check valve 11 by a 3-way manifold.

When the portable air pump is not used, the casing 30 can be pushed back to the inside of the base member 20 manually. After the casing 30 has been pushed back to the inside of the base member 20, the footplate 60 (control member) is turned upwards and closely attached to the pump body 10.

Further, the portable air pump can be designed to have the pressure gauge be automatically moved between the exposed position and the hidden position. For example, a linking device may be coupled between the casing and the footplate (control member). When the user extended out the footplate, the casing is automatically forced out of the base member to expose the pressure gauge; when the user turned the footplate from the extended operative position to the received non-operative position, the casing is automatically pulled back to the inside of the base member to keep the pressure gauge from sight.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A portable air pump, comprising:

a pump body;

an accommodation chamber defined in said pump body;

a pressure gauge accommodated in said accommodation chamber and movable in and out of said accommodation chamber between an exposed position where a person can view pressure readings of said pressure gauge and a hidden position where said pressure gauge is received in said pump body and kept from sight;

a casing carrying said pressure gauge and movable in and out of said accommodation chamber of said pump body, and a piping connected between said pressure gauge and an air output port of said pump body;

locking means disposed in said casing and an inside wall of said accommodation chamber for locking said casing to said pump body in said accommodation chamber, and a control member operable to unlock said locking means;

a spring member set between said casing and said pump body and adapted for pushing said casing out of said accommodation chamber upon operation of said control member to unlock said locking means, wherein said control member is a footplate pivotally connected to said pump body and biasable within about 90 degrees angle between a received non-operative position where said footplate is closely attached to said pump body and an extended operative position where said casing is unlocked from said pump body;

a base member located on a bottom side of said pump body, wherein said base member includes a left wall, a right wall, a top wall, a bottom wall, a rear wall and an opening formed at a front end of said base member for defining said accommodation chamber in the bottom side of said pump body; and the casing carrying said pressure gauge and movable in and out of said accommodation chamber, and a piping connected between said pressure gauge and an air output port of said pump body.

2. The portable air pump as claimed in claim 1, further comprising sliding rail means disposed in one of said base member and said casing, and sliding groove means disposed in the other of said base member and said casing and slidably coupled to said sliding rail means.

3. The portable air pump as claimed in claim 1, further Comprising said footplate pivotally coupled to said pump body and biasable relative to said pump body between the received non-operative position and the extended position, and linking means connected between said footplate and said casing and adapted for moving said casing out of said accommodation chamber when said footplate is biased relative to said pump body from said received non-operative position to said extended operative position and moving said casing into said accommodation chamber when said footplate is biased relative to said pump body from said extended operative position to said received non-operative position.

* * * * *